US005816187A

United States Patent [19]

Jimmie

[11] Patent Number: 5,816,187

[45] Date of Patent: Oct. 6, 1998

[54] DIVER'S SAFETY FLAG

[76] Inventor: Edward J. Jimmie, 524 NE. 5th Ave., Ft. Lauderdale, Fla. 33301

[21] Appl. No.: 831,894

[22] Filed: Apr. 3, 1997

[51] Int. Cl.[6] ..... G09F 17/00

[52] U.S. Cl. ..... 116/173; 116/209

[58] Field of Search ..... 116/173, 174, 116/28 R, 209, 26; 40/479, 506, 591; 441/6, 11; 446/217, 218

[56] References Cited

U.S. PATENT DOCUMENTS

| | | | |
|---|---|---|---|
| 938,710 | 11/1909 | Russell | 40/479 |
| 3,073,047 | 1/1963 | Jones | 40/479 |
| 5,609,122 | 3/1997 | Jimmie | 116/173 |

FOREIGN PATENT DOCUMENTS

| | | | |
|---|---|---|---|
| 493150 | 5/1950 | Belgium | 40/479 |
| 1023706 | 3/1953 | France | 40/479 |
| 27840 | of 1909 | United Kingdom | 40/479 |

*Primary Examiner*—Diego F. F. Gutierrez
*Assistant Examiner*—Andrew Hirschfeld
*Attorney, Agent, or Firm*—Charles J. Prescott

[57] ABSTRACT

A storable diver's flag which is visible in substantially all directions. The flag includes three flexible rectangular panels connected to one another along a common central pocket formed between the panels. The panels are thus vertically automatically radially extendible to an in-use position generally radially equal angles between adjacent panels whereby diver down indicia on both surfaces of the panels allow the upright in-use flag and indicia to be seen from any direction. A support member having an elongated mast and three support arms radially extending from near each end of the mast extend along each radial margin of each panel to maintain the panels in an extended and upstanding in use position. The support member is preferably embedded and adhered in place between each pair of sheet material portions themselves adhered together to form each flag panel.

6 Claims, 2 Drawing Sheets

DIVER'S SAFETY FLAG

BACKGROUND OF THE INVENTION

1. Scope of Invention

This invention relates generally to signal flag devices such as dive flags, and more particularly to a storable diver's flag which is viewable from all directions.

2. Prior Art

The use and general configuration of diver's flags having diver down indicia printed thereon is well known. These flags are generally rectangular in shape having each surface containing a red overall background and a broad diagonal white stripe passing centrally between opposing corners. This flag and viewable indicia is easily recognizable from afar when the flag is oriented at an acute or orthogonal orientation to the viewer. Various viewable signal flags and other such signal devices are known to applicant and are disclosed in the following prior U.S. Pat. Nos.

3,105,459 Conn.
3,149,352 Christiansen
3,280,789 Lewis, et al.
3,640,242 Guinn, et al.
4,599,965 Johnson
4,633,215 Anders, et al.
4,796,553 Cogswell, et al.
4,807,557 Lodisio
4,962,720 Leffel
5,024,179 Leffel
5,450,811 Heiland Because all of these prior art devices include a generally planar flag or panel when outstretched with the viewable indicia printed on one or both sides thereof, should the flag have a generally edgewise orientation with respect to the viewer, the flag will not be seen. Of course, if wind or support member orientation is such that the flag is extended generally transversely or orthogonally with respect to the line of sight, the flag would be easily viewable.

The present invention overcomes this limitation of limited flag viewability by providing a multi-panel diver's flag comprising at least three rectangular panels oriented at equal radial angles one to another of approximately 120° so that the diagonal white stripe or diver down indicia printed on both sides of each panel is easily viewable from any direction. A plastic support frame including an elongated mast and three evenly radially spaced support arms connected at one end thereof to adjacent each end of the mast serve to maintain each of the panels in a substantially fully extended and outstretched orientation for consistent viewability. Apertures formed through each of the panels in evenly spaced array reduce wind resistance without any substantial interference with the viewability of the device.

BRIEF SUMMARY OF THE INVENTION

This invention is directed to a storable diver's flag which is visible in substantially all directions. The flag includes three flexible rectangular panels connected to one another along a common central pocket or cavity between the panels. The panels are thus radially extendible to an in-use position from the central pocket or cavity at generally equal radial angles between adjacent panels whereby diver down indicia on both surfaces of the panels allow the upright in-use flag and indicia to be seen from any direction. A support frame which includes a mast and three flexible elongated support arms each connected at one end thereof in radially evenly spaced relation and extending radially from adjacent each end of the mast with each of the support arms connected to and extending adjacent an upper and lower margin of each panel keeps the panels extended and upstanding in use.

It is therefore an object of this invention to provide a diver's flag having diver down printed indicia thereon which is easily viewable from any direction when the flag is in its upright in-use orientation.

It is yet another object of this invention to provide an easily storable diver's flag having more than two panels bearing diver down indicia thereon oriented at equal angles one to another about an upright central pocket or cavity.

It is still another object of this invention to provide a storable diver's flag which includes an inner support member associated with each of its three panels to maintain the panels in an extended outstanding configuration.

In accordance with these and other objects which will become apparent hereinafter, the instant invention will now be described with reference to the accompanying drawings.

DETAILED DESCRIPTION OF THE INVENTION

Figure 1:
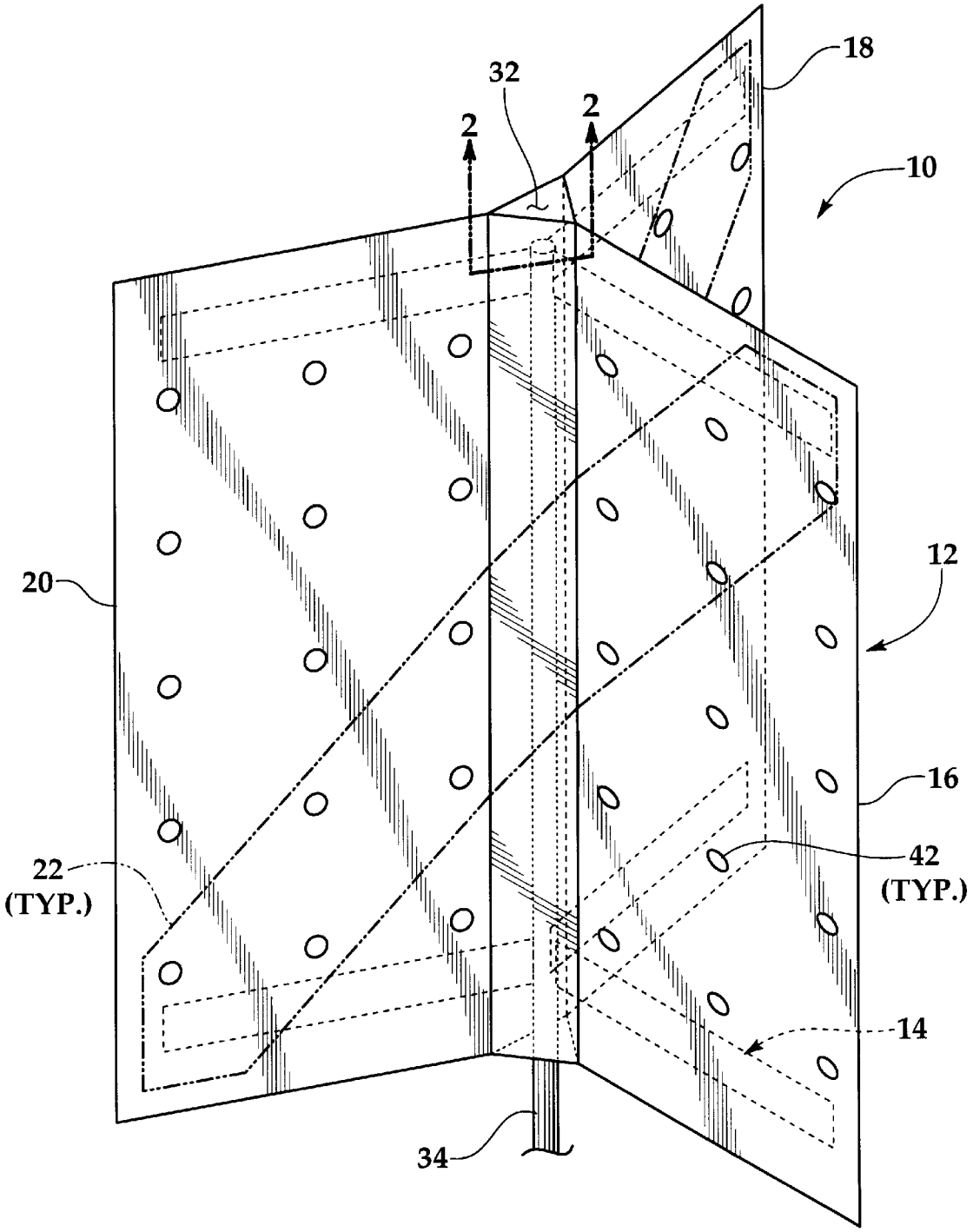
FIG. 1 is a perspective view of the preferred embodiment of invention.

Referring now to the drawings, the preferred embodiment of the invention is shown generally at numeral 10 and comprises a multi-panel diver's flag assembly 12 which includes an inner support frame shown in phantom in FIG. 1 generally at 14.

Figure 2:
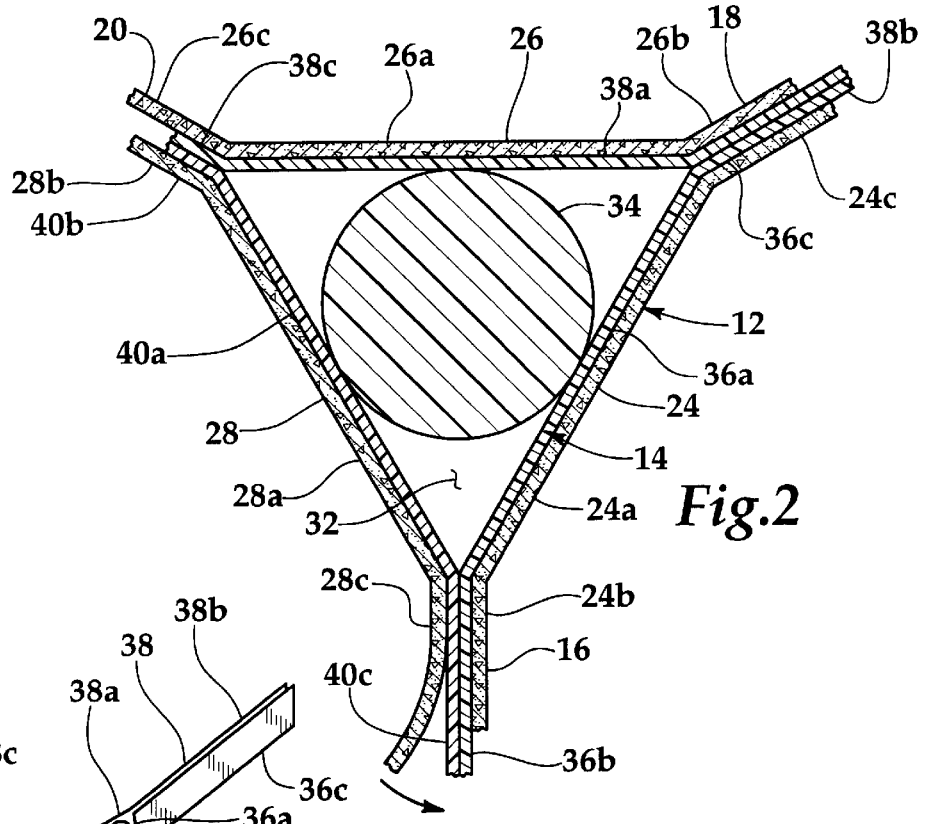
FIG. 2 is a section view in the direction of arrows 2—2 in FIG. 1.

The flag assembly 12 includes three flexible rectangular panels 16, 18 and 20. As best seen in FIGS. 1 and 2, these panels 16, 18 and 20 are formed of three larger rectangular sheets 24, 26 and 28, respectively, made of flexible, water-resistant or water-repellent material such as stiff or semi-stiff rubberized or plasticized or laminated nylon-reinforced vinyl. These flexible sheets 24, 26 and 28 are substantially twice the width of each corresponding panel 16, 18 and 20, sheet portions 24*b*/28*c*, 24*c*/26*b*, and 26*c*/28*b* forming these panels 16, 18 and 20, respectively, when adhered or joined together by adhesive, heat bonding, stitching and the like.

Figure 3:
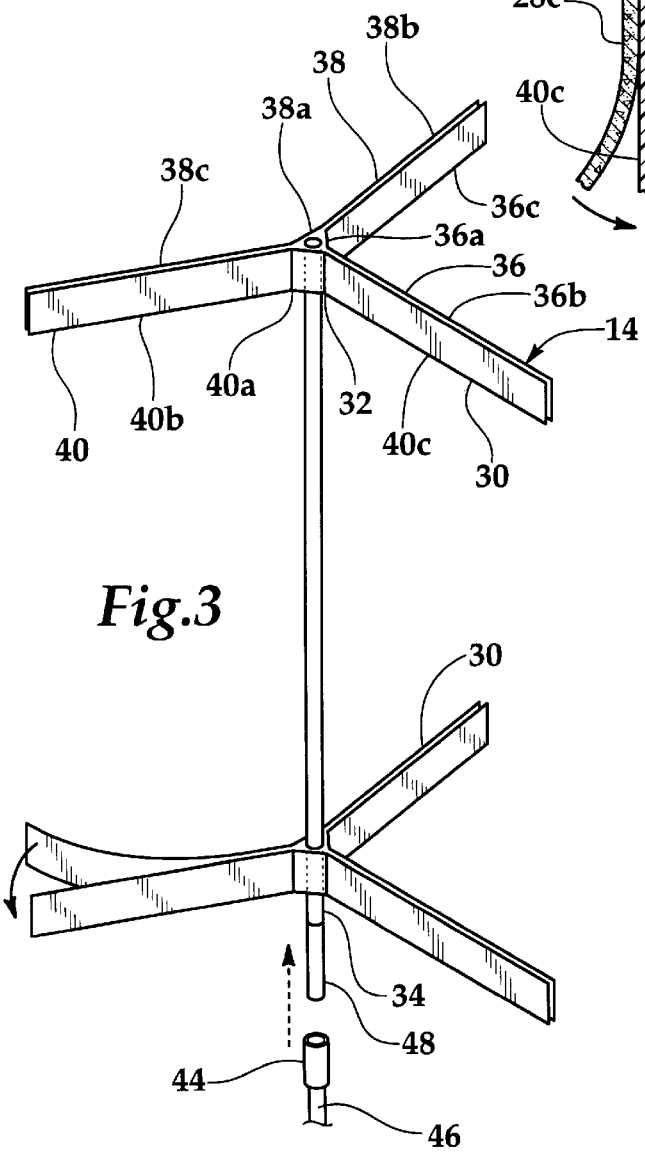
FIG. 3 is a perspective view of an inner support member shown in hidden lines in FIG. 1.

Each of the panels 16, 18 and 20 is supported and maintained in an extended, outstanding orientation by the inner support member 14 which includes an elongated plastic cylindrical mast 34 and three radially extending, evenly spaced flat support arms 36, 38 and 40 connected at one end thereof to and radially extending from adjacent each end of the mast 34 as best seen in FIG. 3. Each of these support arms 36, 38 and 40 are evenly spaced radially at approximately 120° orientation one to another about the longitudinal axis of mast 34. Mast 34 is preferably made of solid fiberglass with a male metal coupler 48 crimped onto a lower end thereof which matingly engages with a female coupler 44 crimped onto an extension rod 46.

Each of the sets of three support arms 36, 38 and 40 are formed of three elongated plastic strips which are generally twice the length of each of the support arms 36, 38 and 40. Plastic strip portions 36*c* and 38*b* are adhered together, 38*c* and 40*b* are adhered together, and 40*c* and 36*b* are similarly adhered together by suitable adhesive or heat sealing methods. A central triangular portion 32 is formed as best seen in FIGS. 2 and 3 by strip portions 36*a*, 38*a* and 40*a* with panel portions 24*a*, 26*a*, and 28*a* adhered thereagainst as seen in FIG. 2. Corresponding support arms 36, 38 and 40 disposed adjacent each end of mast 34 are aligned one to another and to a corresponding imaginary plane passing therethrough and through the mast 34. The material utilized to form each of the support arms 36, 38 and 40 is LEXAN plastic having a thickness of 0.030", the adhesive utilized being WELD-ON #35 acrylic glue.

By this arrangement, the panels 16, 18 and 20 with the support member 14 bonded in place as shown between each of the sheets of flexible material 24, 26 and 28 as best seen in FIG. 1, are held in an upstanding orientation and of generally uniform radial spacing. Mast 34 extends somewhat from one end of the flag assembly 12 for interconnection to another elongated mast or boat or float structure as desired with the flat assembly 12 upwardly extending therefrom.

Referring to FIG. 1, to minimize or to reduce the amount of drag placed upon the device 10 in stronger wind conditions, a series of evenly spaced apertures shown typically at 42 are formed through each of the flat panels 16, 18 and 20. These holes are sized approximately ⅜" in diameter and are disposed in an array of three columns and five rows which has been shown to be effective for this purpose of wind drag reduction.

With the majority of both surfaces of the panels 16, 18 and 20 being red, a white diagonal stripe shown in phantom typically at 22 is applied from the lower corner of one panel to the upper corner of the next adjacent panel. This arrangement and configuration of this well known diagonal white "diver down" stripe 22 provides additional width and length for heightened viewability by being extended over two rectangular surfaces of adjacent panels 16, 18, or 20.

Figure 4:
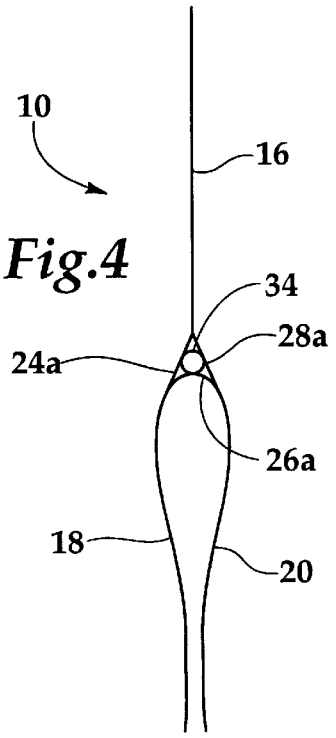
FIG. 4 is an end view of the invention shown in FIG. 1 with the panels in a folded, flat orientation for storage.

FIG. 4 depicts the storability of flag assembly 10. Panels 16, 18 and 20, formed of relatively stiff material as previously described, will nonetheless generally flex, along with the plastic support arms 36, 38 and 40 embedded therein into the orientation shown. In this resiliently flexed flattened condition, the flag assembly 10 may be easily stored in a drawer or atop a shelf to resiliently rebound into the natural in-use position shown in FIG. 1 for use thereafter.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A storable multi-panel diver's safety flag comprising:

a support frame including an elongated substantially straight mast and a support member adjacent each end of said mast, each said support member having three flexible substantially evenly spaced elongated support arms each connected at one end thereof to, and extending from, said mast with corresponding said support arms adjacent each end of said mast being radially aligned one to another;

three flexible rectangular shaped panels formed of three sheets of flexible material having a width substantially twice that of each said panel, said sheets connected together about a common central portion of each said sheet to define a substantially straight central elongated pocket or cavity and three mating pairs of connected sheet half portions, each said pair becoming one said panel, said panels being extendible radially from said pocket or cavity in spaced angular orientation one to another;

said support frame connected to said panels with said mast positioned along substantially an entire length of said pocket or cavity and said support arms connected against each said panel adjacent and along an upper and a lower margin of each said panel;

said support arms being resiliently flexible permitting adjacent of said panels to fold against one another;

diver down indicia on each said sheet viewable in any generally horizontal direction from said panels when in use.

2. A diver's safety flag as set forth in claim 1, wherein:

each said panel includes an array of wind load reducing apertures each sized to allow wind to pass therethrough whereby wind load on said mast, when the wind hits said panels, is reduced.

3. A diver's safety flag comprising:

three flexible rectangular shaped panels extending radially from a common central elongated pocket or cavity in spaced angular orientation one to another;

an elongated slender mast connected within and extending along said central pocket or cavity;

a support member adjacent each end of said mast, each said support member having an elongated slender support arm for each said panel and radially extending from, said mast, each said support arm being embedded within each said panel whereby each said panel is held generally straight and upstanding about said mast for maintaining said panels substantially in said angular orientation;

said support arms being resiliently flexible permitting adjacent of said panels to fold against one another;

diver down indicia on each said sheet viewable in any generally horizontal direction from said panels in use.

4. A diver's safety flag as set forth in claim 3, wherein:

each said panel includes an array of wind load reducing apertures each sized to allow wind to pass therethrough whereby wind load on said mast, when the wind hits said panels, is reduced.

5. A storable multi-panel diver's safety flag comprising:

an inner support frame including an elongated substantially straight mast and a support member adjacent each end of said mast, each said support member having three flexible substantially evenly spaced elongated support arms each connected at one end thereof to, and extending from, said mast with corresponding said support arms adjacent each end of said mast being radially aligned one to another;

three flexible rectangular shaped panels formed of three sheets of flexible material having a width substantially twice that of each said panel, said sheets connected together about a common central portion of each said sheet to define a substantially straight central elongated pocket or cavity and three mating pairs of connected sheet half portions, each said pair becoming one said panel, said panels being extendible radially from said pocket or cavity in spaced angular orientation one to another;

said support frame connected between said sheets with said mast positioned within said pocket or cavity and said support arms connected between each pair of connected said sheets adjacent and along an upper and a lower margin of each said panel;

said support arms being resiliently flexible permitting adjacent of said panels to fold against one another;

diver down indicia on each said sheet viewable in any generally horizontal direction from said panels when in use.

6. A diver's safety flag as set forth in claim 5, wherein:

each said panel includes an array of wind load reducing apertures each sized to allow wind to pass therethrough whereby wind load on said mast, when the wind hits said panels, is reduced.

* * * * *